United States Patent [19]

Aldag, Jr. et al.

[11] Patent Number: 4,724,069

[45] Date of Patent: Feb. 9, 1988

[54] HYDROFINING PROCESS FOR HYDROCARBON CONTAINING FEED STREAMS

[75] Inventors: Arthur W. Aldag, Jr.; Stephen L. Parrott; Simon G. Kukes, all of Bartlesville, Okla.

[73] Assignee: Phillips Petroleum Company, Bartlesville, Okla.

[21] Appl. No.: 896,916

[22] Filed: Aug. 15, 1986

[51] Int. Cl.[4] ..... C10G 45/00; C10G 45/06

[52] U.S. Cl. ..... 208/217; 208/251 A; 208/254 H; 208/213

[58] Field of Search ..... 208/217, 251 A, 254 H

[56] References Cited

U.S. PATENT DOCUMENTS

| | | | |
|---|---|---|---|
| 3,161,585 | 12/1984 | Gleim et al. | 208/264 |
| 3,196,104 | 7/1965 | Gleim et al. | 208/264 |
| 3,331,769 | 7/1967 | Gatsis | 208/210 |
| 3,836,453 | 9/1954 | Kovach | 208/254 H |
| 3,838,042 | 9/1974 | Beuther et al. | 208/251 H |
| 4,066,530 | 1/1978 | Aldridge et al. | 208/112 |
| 4,134,825 | 1/1979 | Bearden, Jr. et al. | 208/108 |
| 4,226,742 | 10/1980 | Bearden, Jr. et al. | 252/431 |
| 4,285,804 | 8/1981 | Jacquin et al. | 208/48 |
| 4,298,454 | 11/1981 | Aldridge et al. | 208/10 |
| 4,357,229 | 11/1982 | Bearden, Jr. et al. | 208/10 |
| 4,389,301 | 6/1983 | Dahlberg et al. | 208/59 |
| 4,399,024 | 8/1983 | Fukui et al. | 208/131 |
| 4,430,207 | 2/1984 | Kukes | 208/251 H |
| 4,450,068 | 5/1984 | Kukes | 208/251 H |
| 4,551,230 | 11/1985 | Kukes et al. | 208/251 H |
| 4,557,823 | 12/1985 | Kukes et al. | 208/251 H |
| 4,557,824 | 12/1985 | Kukes et al. | 208/251 H |
| 4,560,468 | 12/1985 | Kukes et al. | 208/251 H |
| 4,564,441 | 1/1986 | Kukes et al. | 208/251 H |
| 4,578,180 | 3/1986 | Kukes et al. | 208/251 H |

OTHER PUBLICATIONS

Novel Catalyst and Process for Upgrading Residua and Heavy Crudes, Roby Bearden and Clyde L. Aldridge, Aiche 90th National Meeting, Apr. 5-9, 1981.

*Primary Examiner*—Andrew H. Metz
*Assistant Examiner*—Helane Myers
*Attorney, Agent, or Firm*—J. Michael Simpson

[57] ABSTRACT

An additive comprising a metal naphthenate selected from the group consisting of cobalt naphthenate and iron naphthenate is mixed with a hydrocarbon-containing feed stream. The hydrocarbon-containing feed stream containing the additive is then contacted in a hydrofining process with a catalyst composition comprising a support selected from the group consisting of alumina, silica and silica-alumina and a promoter comprising at least one metal selected from Group VIB, Group VIIB and Group VIII of the Periodic Table. The introduction of the inventive additive may be commenced when the catalyst is new, partially deactivated or spent with a beneficial result occuring in each case.

31 Claims, No Drawings

HYDROFINING PROCESS FOR HYDROCARBON CONTAINING FEED STREAMS

This invention relates to a hydrofining process for hydrocarbon-containing feed streams. In one aspect, this invention relates to a process for removing metals from a hydrocarbon-containing feed stream. In another aspect, this invention relates to a process for removing sulfur or nitrogen from a hydrocarbon-containing feed stream. In still another aspect, this invention relates to a process for removing potentially cokeable components from a hydrocarbon-containing feed stream. In still another aspect, this invention relates to a process for reducing the amount of heavies in a hydrocarbon-containing feed stream.

It is well known that crude oil as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalysts employed in processes such as catalytic cracking, hydrogenation or hydrodesulfurization.

The presence of other components such as sulfur and nitrogen is also considered detrimental to the processability of a hydrocarbon-containing feed stream. Also, hydrocarbon-containing feed streams may contain components (referred to as Ramsbottom carbon residue) which are easily converted to coke in processes such as catalytic cracking, hydrogenation or hydrodesulfurization. It is thus desirable to remove components such as sulfur and nitrogen and components which have a tendency to produce coke.

It is also desirable to reduce the amount of heavies in the heavier fractions such as the topped crude and residuum. As used herein the term heavies refers to the fraction having a boiling range higher than about 1000° F. This reduction results in the production of lighter components which are of higher value and which are more easily processed.

It is thus an object of this invention to provide a process to remove components such as metals, sulfur, nitrogen and Ramsbottom carbon residue from a hydrocarbon-containing feed stream and to reduce the amount of heavies in the hydrocarbon-containing feed stream (one or all of the described removals and reduction may be accomplished in such process, which is generally refered to as a hydrofining process, depending upon the components contained in the hydrocarbon-containing feed stream). Such removal or reduction provides substantial benefits in the subsequent processing of the hydrocarbon-containing feed streams.

In accordance with the present invention, a hydrocarbon-containing feed stream, which also contains metals (such as vanadium, nickel and iron), sulfur, nitrogen and/or Ramsbottom carbon residue, is contacted with a solid catalyst composition comprising alumina, silica or silica-alumina. The catalyst composition also contains at least one metal selected from Group VIB, Group VIIB, and Group VIII of the Periodic Table, in the oxide or sulfide form. An additive comprising a metal naphthenate selected from the group consisting of cobalt naphthenate and iron naphthenate is mixed with the hydrocarbon-containing feed stream prior to contacting the feed stream with the catalyst composition. The hydrocarbon-containing feed stream, which also contains the additive, is contacted with the catalyst composition in the presence of hydrogen under suitable hydrofining conditions. After being contacted with the catalyst composition, the hydrocarbon-containing feed stream will contain a significantly reduced concentration of metals, sulfur, nitrogen and Ramsbottom carbon residue as well as a reduced amount of heavy hydrocarbon components. Removal of these components from the hydrocarbon-containing feed stream in this manner provides an improved processability of the hydrocarbon-containing feed stream in processes such as catalytic cracking, hydrogenation or further hydrodesulfurization. The use of the inventive additive results in an improved removal of metals, primarily vanadium and nickel.

The additive of the present invention may be added when the catalyst composition is fresh or at any suitable time thereafter. As used herein, the term "fresh catalyst" refers to a catalyst which is new or which has been reactivated by known techniques. The activity of fresh catalyst will generally decline as a function of time if all conditions are maintained constant. It is believed that the introduction of the inventive additive will slow the rate of decline from the time of introduction and in some cases will dramatically improve the activity of an at least partially spent or deactivated catalyst from the time of introduction.

For economic reasons it is sometimes desirable to practice the hydrofining process without the addition of the additive of the present invention until the catalyst activity declines below an acceptable level. In some cases, the activity of the catalyst is maintained constant by increasing the process temperature. The inventive additive is added after the activity of the catalyst has dropped to an unacceptable level and the temperature cannot be raised further without adverse consequences. It is believed that the addition of the inventive additive at this point will result in a dramatic increase in catalyst activity based on the results set forth in Example IV.

Other objects and advantages of the invention will be apparent from the foregoing brief description of the invention and the appended claims as well as the detailed description of the invention which follows.

The catalyst composition used in the hydrofining process to remove metals, sulfur, nitrogen and Ramsbottom carbon residue and to reduce the concentration of heavies comprises a support and a promoter. The support comprises alumina, silica or silica-alumina. Suitable supports are believed to be $Al_2O_3$, $SiO_2$, $Al_2O_3$-$SiO_2$, $Al_2O_3$-$TiO_2$, $Al_2O_3$-$BPO_4$, $Al_2O_3$-$AlPO_4$, $Al_2O_3$-$Zr_3(PO_4)_4$, $Al_2O_3$-$SnO_2$ and $Al_2O_3$-$ZnO_2$. Of these supports, $Al_2O_3$ is particularly preferred.

The promoter comprises at least one metal selected from the group consisting of the metals of Group VIB, Group VIIB, and Group VIII of the Periodic Table. The promoter will generally be present in the catalyst composition in the form of an oxide or sulfide. Particularly suitable promoters are iron, cobalt, nickel, tungsten, molybdenum, chromium, manganese, vanadium and platinum. Of these promoters, cobalt, nickel, molybdenum and tungsten are the most preferred. A particularly preferred catalyst composition is $Al_2O_3$ promoted by CoO and $MoO_3$ or promoted by CoO, NiO and $MoO_3$.

Generally, such catalysts are commercially available. The concentration of cobalt oxide in such catalysts is typically in the range of about 0.5 weight percent to about 10 weight percent based on the weight of the total catalyst composition. The concentration of molybdenum oxide is generally in the range of about 2 weight percent to about 25 weight percent based on the weight of the total catalyst composition. The concentration of nickel oxide in such catalysts is typically in the range of about 0.3 weight percent to about 10 weight percent based on the weight of the total catalyst composition. Pertinent properties of four commercial catalysts which are believed to be suitable are set forth in Table I.

TABLE I

| Catalyst | CoO (Wt. %) | MoO (Wt. %) | NiO (Wt. %) | Bulk Density* (g/cc) | Surface Area ($M^2/g$) |
|---|---|---|---|---|---|
| Shell 344 | 2.99 | 14.42 | — | 0.79 | 186 |
| Katalco 477 | 3.3 | 14.0 | — | .64 | 236 |
| KF - 165 | 4.6 | 13.9 | — | .76 | 274 |
| Commercial Catalyst D Harshaw Chemical Company | 0.92 | 7.3 | 0.53 | — | 178 |

*Measured on 20/40 mesh particles, compacted.

The catalyst composition can have any suitable surface area and pore volume. In general, the surface area will be in the range of about 2 to about 400 $m^2/g$, preferably about 100 to about 300 $m^2/g$, while the pore volume will be in the range of about 0.1 to about 4.0 cc/g, preferably about 0.3 to about 1.5 cc/g.

Presulfiding of the catalyst is preferred before the catalyst is initially used. Many presulfiding procedures are known and any conventional presulfiding procedure can be used. A preferred presulfiding procedure is the following two step procedure.

The catalyst is first treated with a mixture of hydrogen sulfide in hydrogen at a temperature in the range of about 175° C. to about 225° C., preferably about 205° C. The temperature in the catalyst composition will rise during this first presulfiding step and the first presulfiding step is continued until the temperature rise in the catalyst has substantially stopped or until hydrogen sulfide is detected in the effluent flowing from the reactor. The mixture of hydrogen sulfide and hydrogen preferably contains in the range of about 5 to about 20 percent hydrogen sulfide, preferably about 10 percent hydrogen sulfide.

The second step in the preferred presulfiding process consists of repeating the first step at a temperature in the range of about 350° C. to about 400° C., preferably about 370° C., for about 2–3 hours. It is noted that other mixtures containing hydrogen sulfide may be utilized to presulfide the catalyst. Also the use of hydrogen sulfide is not required. In a commercial operation, it is common to utilize a light naphtha containing sulfur to presulfide the catalyst.

As has been previously stated, the present invention may be practiced when the catalyst is fresh or the addition of the inventive additive may be commenced when the catalyst has been partially deactivated. The addition of the inventive may be delayed until the catalyst is considered spent.

In general, a "spent catalyst" refers to a catalyst which does not have sufficient activity to produce a product which will meet specifications, such as maximum permissible metals content, under available refinery conditions. For metals removal, a catalyst which removes less than about 50% of the metals contained in the feed is generally considered spent.

A spent catalyst is also sometimes defined in terms of metals loading (nickel+vanadium). The metals loading which can be tolerated by different catalyst varies but a catalyst whose weight has increased at least about 15% due to metals (nickel+vanadium) is generally considered a spent catalyst.

Any suitable hydrocarbon-containing feed stream may be hydrofined using the above described catalyst composition in accordance with the present invention. Suitable hydrocarbon-containing feed streams include petroleum products, coal, pyrolyzates, products from extraction and/or liquefaction of coal and lignite, products from tar sands, products from shale oil and similar products. Suitable hydrocarbon feed streams include gas oil having a boiling range from about 205° C. to about 538° C., topped crude having a boiling range in excess of about 343° C. and residuum. However, the present invention is particularly directed to heavy feed streams such as heavy topped crudes and residuum and other materials which are generally regarded as too heavy to be distilled. These materials will generally contain the highest concentrations of metals, sulfur, nitrogen and Ramsbottom carbon residues.

It is believed that the concentration of any metal in the hydrocarbon-containing feed stream can be reduced using the above described catalyst composition in accordance with the present invention. However, the present invention is particularly applicable to the removal of vanadium, nickel and iron.

The sulfur which can be removed using the above described catalyst composition in accordance with the present invention will generally be contained in organic sulfur compounds. Examples of such organic sulfur compounds include sulfides, disulfides, mercaptans, thiophenes, benzylthiophenes, dibenzylthiophenes, and the like.

The nitrogen which can be removed using the above described catalyst composition in accordance with the present invention will also generally be contained in organic nitrogen compounds. Examples of such organic nitrogen compounds include amines, diamines, pyridines, quinolines, porphyrins, benzoquinolines and the like.

While the above described catalyst composition is effective for removing some metals, sulfur, nitrogen and Ramsbottom carbon residue, the removal of metals can be significantly improved in accordance with the present invention by introducing an additive comprising a metal naphthenate selected from the group consisting of cobalt naphthenate and iron naphthenate into the hydrocarbon-containing feed stream prior to contacting the feed stream with the catalyst composition. As has been previously stated, the introduction of the inventive additive may be commenced when the catalyst is new, partially deactivated or spent with a beneficial result occurring in each case.

Any suitable concentration of the inventive additive may be added to the hydrocarbon-containing feed stream. In general, a sufficient quantity of the additive will be added to the hydrocarbon-containing feed stream to result in an added concentration of either cobalt or iron, as the elemental metals, in the range of about 1 to about 60 ppm and more preferably in the range of about 2 to about 30 ppm.

High concentrations such as about 100 ppm and above should be avoided to prevent plugging of the reactor. It is noted that one of the particular advantages of the present invention is the very small concentrations of cobalt or iron which result in a significant improvement. This substantially improves the economic viability of the process.

After the inventive additive has been added to the hydrocarbon-containing feed stream for a period of time, it is believed that only periodic introduction of the additive is required to maintain the efficiency of the process.

The inventive additive may be combined with the hydrocarbon-containing feed stream in any suitable manner. The additive may be mixed with the hydrocarbon-containing feed stream as a solid or liquid or may be dissolved in a suitable solvent (preferably an oil) prior to introduction into the hydrocarbon-containing feed stream. Any suitable mixing time may be used. However, it is believed that simply injecting the additive into the hydrocarbon-containing feed stream is sufficient. No special mixing equipment or mixing period are required.

The pressure and temperature at which the inventive additive is introduced into the hydrocarbon-containing feed stream is not thought to be critical. However, a temperature below 450° C. is recommended.

The hydrofining process can be carried out by means of any apparatus whereby there is achieved a contact of the catalyst composition with the hydrocarbon-containing feed stream and hydrogen under suitable hydrofining conditions. The hydrofining process is in no way limited to the use of a particular apparatus. The hydrofining process can be carried out using a fixed catalyst bed, fluidized catalyst bed or a moving catalyst bed. Presently preferred is a fixed catalyst bed.

Any suitable reaction time between the catalyst composition and the hydrocarbon-containing feed stream may be utilized. In general, the reaction time will range from about 0.1 hours to about 10 hours. Preferably, the reaction time will range from about 0.3 to about 5 hours. Thus, the flow rate of the hydrocarbon-containing feed stream should be such that the time required for the passage of the mixture through the reactor (residence time) will preferably be in the range of about 0.3 to about 5 hours. This generally requires a liquid hourly space velocity (LHSV) in the range of about 0.10 to about 10 cc of oil per cc of catalyst per hour, preferably from about 0.2 to about 3.0 cc/cc/hr.

The hydrofining process can be carried out at any suitable temperature. The temperature will generally be in the range of about 150° C. to about 550° C. and will preferably be in the range of about 340° to about 440° C. Higher temperatures do improve the removal of metals but temperatures should not be utilized which will have adverse effects on the hydrocarbon-containing feed stream, such as coking, and also economic considerations must be taken into account. Lower temperatures can generally be used for lighter feeds.

Any suitable hydrogen pressure may be utilized in the hydrofining process. The reaction pressure will generally be in the range of about atmospheric to about 10,000 psig. Preferably, the pressure will be in the range of about 500 to about 3,000 psig. Higher pressures tend to reduce coke formation but operation at high pressure may have adverse economic consequences.

Any suitable quantity of hydrogen can be added to the hydrofining process. The quantity of hydrogen used to contact the hydrocarbon-containing feed stock will generally be in the range of about 100 to about 20,000 standard cubic feet per barrel of the hydrocarbon-containing feed stream and will more preferably be in the range of about 1,000 to about 6,000 standard cubic feet per barrel of the hydrocarbon-containing feed stream.

In general, the catalyst composition is utilized until a satisfactory level of metals removal fails to be achieved which is believed to result from the coating of the catalyst composition with the metals being removed. It is possible to remove the metals from the catalyst composition by certain leaching procedures but these procedures are expensive and it is generally contemplated that once the removal of metals falls below a desired level, the used catalyst will simply be replaced by a fresh catalyst.

The time in which the catalyst composition will maintain its activity for removal of metals will depend upon the metals concentration in the hydrocarbon-containing feed streams being treated. It is believed that the catalyst composition may be used for a period of time long enough to accumulate 10–200 weight percent of metals, mostly Ni, V, and Fe, based on the weight of the catalyst composition, from oils.

The following examples are presented in further illustration of the invention.

EXAMPLE I

In this example, the process and apparatus used for hydrofining heavy oils in accordance with the present invention is described. Oil, with or without decomposable additives, was pumped downward through an induction tube into a trickle bed reactor which was 28.5 inches long and 0.75 inches in diameter. The oil pump used was a Whitey Model LP 10 (a reciprocating pump with a diaphragm-sealed head; marketed by Whitey Corp., Highland Heights, Ohio). The oil induction tube extended into a catalyst bed (located about 3.5 inches below the reactor top) comprising a top layer of about 40 cc of low surface area α-alumina (14 grit Alundum; surface area less than 1 $m^2$/gram; marketed by Norton Chemical Process Products, Akron, Ohio), a middle layer of about 45 cc of a hydrofining catalyst, mixed with about 90 cc of 36 grit Alundum and a bottom layer of about 30 cc of α-alumina.

The hydrofining catalyst used was a fresh, commercial, promoted desulfurization catalyst (referred to as catalyst D in table I) marketed by Harshaw Chemical Company, Beachwood, Ohio. The catalyst had an $Al_2O_3$ support having a surface area of 178 $m^2$/g (determined by BET method using $N_2$ gas), a medium pore diameter of 140 Å and a total pore volume of 0.682 cc/g (both determined by mercury porosimetry in accordance with the procedure described by American Instrument Company, Silver Springs, Md., catalog number 5-7125-13). The catalyst contained 0.92 wt-% Co (as cobalt oxide), 0.53 weight-% Ni (as nickel oxide); 7.3 wt-% Mo (as molybdenum oxide).

The catalyst was presulfided as follows. A heated tube reactor was filled with an 8 inch high bottom layer of Alundum, a 7–8 inch high middle layer of catalyst D, and an 11 inch top layer of Alundum. The reactor was purged with nitrogen and then the catalyst was heated for one hour in a hydrogen stream to about 400° F. While the reactor temperature was maintained at about 400° F., the catalyst was exposed to a mixture of hydrogen (0.46 scfm) and hydrogen sulfide (0.049 scfm) for about two hours. The catalyst was then heated for about one hour in the mixture of hydrogen and hydrogen sulfide to a temperature of about 700° F. The reactor temperature was then maintained at 700° F. for two hours while the catalyst continued to be exposed to the mixture of hydrogen and hydrogen sulfide. The catalyst was then allowed to cool to ambient temperature conditions in the mixture of hydrogen and hydrogen sulfide and was finally purged with nitrogen.

Hydrogen gas was introduced into the reactor through a tube that concentrically surrounded the oil induction tube but extended only as far as the reactor top. The reactor was heated with a Thermcraft (Winston-Salem, N.C.) Model 211 3-zone furnace. The reactor temperature was measured in the catalyst bed at three different locations by three separate thermocouples embedded in an axial thermocouple well (0.25 inch outer diameter). The liquid product oil was generally collected every day for analysis. The hydrogen gas was vented. Vanadium and nickel contents were determined by plasma emission analysis; sulfur content was measured by X-ray fluorescence spectrometry; Ramsbottom carbon residue was determined in accordance with ASTM D524; pentane insolubles were measured in accordance with ASTM D893; and nitrogen content was measured in accordance with ASTM D3228.

The additives used were mixed in the feed by adding a desired amount to the oil and then shaking and stirring the mixture. The resulting mixture was supplied through the oil induction tube to the reactor when desired.

EXAMPLE II

A desalted, topped (400° F.+) Maya heavy crude (density at 38.5° C.: 0.9569 g/cc) was hydrotreated in accordance with the procedure described in Example I. The hydrogen feed rate was about 2,500 standard cubic feet (SCF) of hydrogen per barrel of oil; the temperature was about 750° F.; and the pressure was about 2250 psig. The results received from the test were corrected to reflect a standard liquid hourly space velocity (LHSV) for the oil of about 1.0 cc/cc catalyst/hr. The molybdenum compound added to the feed in run 2 was Molyvan ®L, an antioxidant and antiwear lubricant additive marketed by R. T. Vanderbilt Company, Norwalk, Ct. Molyvan ®L is a mixture of about 80 weight-% of a sulfurized oxy-molybdenum (V) dithiophosphate of the formula $Mo_2S_2O_2[PS_2(OR)_2]$, wherein R is the 2-ethylhexyl group, and about 20 weight-% of an aromatic petroleum oil (Flexon 340; specific gravity: 0.963; viscosity at 210° F.: 38.4 SUS; marketed by Exxon Company U.S.A., Houston, TX). The molybdenum compound added to the feed in run 3 was a molybdenum naphthenate containing about 3.0 wt-% molybdenum (No. 25306, Lot #CC-7579; marketed by ICN Pharmaceuticals, Plainview, N.Y.). The vanadium compound added to the feed in run 4 was a vanadyl naphthenate containing about 3.0 wt-% vanadium (No. 19804, Lot #49680-A; marketed by ICN Pharmaceuticals, Plainview, N.Y.). The cobalt compound added to the feed in run 5 was a cobalt naphthenate containing about 6.2 wt-% cobalt (No. 1134, Lot #86403; marketed by K&K Laboratories, Plainview, N.Y.). The iron compound added to the feed in run 6 was an iron naphthenate containing about 6.0 wt-% iron (No. 7902, Lot #28096-A; marketed by ICN Pharmaceuticals, Plainview, N.Y.). The results of these tests are set forth in Table II.

TABLE II

| | | | PPM in Feed | | | | PPM in Product | | | |
|---|---|---|---|---|---|---|---|---|---|---|
| Run | Hours on Stream | Temp (°F.) | Added Metal | Ni | V | Ni + V | Ni | V | Ni + V | % Removal of (Ni + V) |
| 1 | 30 | 750 | 0 | 65 | 338 | 403 | 19 | 61 | 80 | 80 |
| (Control) | 54 | 750 | 0 | 65 | 338 | 403 | 23 | 76 | 99 | 75 |
| No Additive | 78 | 750 | 0 | 65 | 338 | 403 | 22 | 73 | 95 | 76 |
| | 102 | 750 | 0 | 65 | 338 | 403 | 24 | 79 | 103 | 74 |
| | 126 | 750 | 0 | 65 | 338 | 403 | 24 | 83 | 107 | 73 |
| | 150 | 750 | 0 | 65 | 338 | 403 | 27 | — | — | — |
| | 174 | 750 | 0 | 65 | 338 | 403 | 26 | 79 | 105 | 74 |
| | 198 | 750 | 0 | 65 | 338 | 403 | 25 | 76 | 101 | 75 |
| | 222 | 750 | 0 | 65 | 338 | 403 | 27 | 79 | 106 | 74 |
| | 246 | 750 | 0 | 65 | 338 | 403 | 27 | 80 | 107 | 73 |
| | 270 | 750 | 0 | 65 | 338 | 403 | 31 | 94 | 125 | 69 |
| | 294 | 750 | 0 | 65 | 338 | 403 | 28 | 88 | 116 | 71 |
| | 296 | 750 | 0 | 65 | 338 | 403 | — | — | — | — |
| | 321 | 750 | 0 | 65 | 338 | 403 | 24 | 73 | 97 | 76 |
| | 345 | 750 | 0 | 65 | 338 | 403 | 27 | 92 | 119 | 71 |
| | 369 | 750 | 0 | 65 | 338 | 403 | 24 | 78 | 102 | 75 |
| | 393 | 750 | 0 | 65 | 338 | 403 | 27 | 94 | 121 | 70 |
| 2 | 31 | 750 | 19 | 65 | 338 | 403 | 28 | 94 | 122 | 70 |
| (Control) | 55 | 750 | 19 | 65 | 338 | 403 | 25 | 82 | 107 | 73 |
| Mo Added | 79 | 750 | 19 | 65 | 338 | 403 | 28 | 106 | 134 | 67 |
| | 103 | 750 | 19 | 65 | 338 | 403 | 27 | 89 | 116 | 71 |
| | 127 | 750 | 19 | 65 | 338 | 403 | 24 | 75 | 99 | 75 |
| | 151 | 750 | 19 | 65 | 338 | 403 | 25 | 82 | 107 | 73 |
| | 175 | 750 | 19 | 65 | 338 | 403 | 29 | 97 | 126 | 69 |
| | 199 | 750 | 19 | 65 | 338 | 403 | 25 | 73 | 98 | 76 |
| | 223 | 750 | 19 | 65 | 338 | 403 | 24 | 78 | 102 | 75 |
| | 247 | 750 | 19 | 65 | 338 | 403 | 21 | 68 | 89 | 78 |
| | 271 | 750 | 19 | 65 | 338 | 403 | 21 | 67 | 88 | 78 |
| | 295 | 750 | 19 | 65 | 338 | 403 | 23 | 56 | 79 | 80 |
| | 319 | 750 | 19 | 65 | 338 | 403 | 23 | 70 | 93 | 77 |
| | 343 | 750 | 19 | 65 | 338 | 403 | 26 | 80 | 106 | 74 |
| 3 | 31 | 750 | 25 | 62 | 329 | 391 | 24 | 90 | 114 | 71 |
| (Control) | 55 | 750 | 25 | 62 | 329 | 391 | 26 | 96 | 122 | 69 |
| Mo Added | 79 | 750 | 25 | 62 | 329 | 391 | 26 | 98 | 124 | 68 |
| | 103 | 750 | 25 | 62 | 329 | 391 | 28 | 97 | 125 | 68 |
| | 127 | 750 | 25 | 62 | 329 | 391 | 25 | 90 | 115 | 71 |

TABLE II-continued

| Run | Hours on Stream | Temp (°F.) | PPM in Feed Added Metal | Ni | V | Ni + V | PPM in Product Ni | V | Ni + V | % Removal of (Ni + V) |
|---|---|---|---|---|---|---|---|---|---|---|
| | 151 | 750 | 25 | 62 | 329 | 391 | 27 | 91 | 118 | 70 |
| | 175 | 750 | 25 | 62 | 329 | 391 | 26 | 92 | 118 | 70 |
| | 199 | 750 | 25 | 62 | 329 | 391 | 26 | 96 | 122 | 69 |
| | 237 | 750 | 25 | 62 | 329 | 391 | 29 | 99 | 128 | 67 |
| | 261 | 750 | 25 | 62 | 329 | 391 | 27 | 100 | 127 | 68 |
| | 282 | 750 | 25 | 62 | 329 | 391 | 29 | 104 | 133 | 66 |
| | 306 | 750 | 25 | 62 | 329 | 391 | 29 | 106 | 135 | 65 |
| 4 | 32 | 750 | 25 | 60 | 296 | 381 | 30 | 113 | 143 | 62 |
| (Control) | 56 | 750 | 25 | 60 | 296 | 381 | 25 | 82 | 107 | 72 |
| V Added | 80 | 750 | 25 | 60 | 296 | 381 | 26 | 81 | 107 | 72 |
| | 104 | 750 | 25 | 60 | 296 | 381 | 25 | 77 | 102 | 73 |
| | 128 | 750 | 25 | 60 | 296 | 381 | 25 | 83 | 108 | 72 |
| | 152 | 750 | 25 | 60 | 296 | 381 | 26 | 83 | 109 | 71 |
| | 176 | 750 | 25 | 60 | 296 | 381 | 25 | 78 | 103 | 73 |
| | 200 | 750 | 25 | 60 | 296 | 381 | 27 | 91 | 118 | 69 |
| | 240 | 750 | 25 | 60 | 296 | 381 | 28 | 101 | 129 | 66 |
| | 264 | 750 | 25 | 60 | 296 | 381 | 30 | 112 | 142 | 63 |
| | 288 | 750 | 25 | 60 | 296 | 381 | 29 | 107 | 136 | 64 |
| | 312 | 750 | 25 | 60 | 296 | 381 | 25 | 88 | 113 | 70 |
| | 336 | 750 | 25 | 60 | 296 | 381 | — | — | — | — |
| | 360 | 750 | 25 | 60 | 296 | 381 | 28 | 112 | 140 | 63 |
| 5 | 31 | 750 | 25 | 60 | 352 | 412 | 18 | 31 | 49 | 88 |
| (Invention) | 55 | 750 | 25 | 60 | 352 | 412 | 20 | 45 | 65 | 84 |
| Co Added | 79 | 750 | 25 | 60 | 352 | 412 | 17 | 39 | 56 | 86 |
| | 103 | 750 | 25 | 60 | 352 | 412 | 21 | 47 | 68 | 83 |
| | 127 | 750 | 25 | 60 | 352 | 412 | 20 | 46 | 66 | 84 |
| | 151 | 750 | 25 | 60 | 352 | 412 | 21 | 49 | 70 | 83 |
| | 177 | 750 | 25 | 60 | 352 | 412 | 25 | 59 | 84 | 80 |
| | 200 | 750 | 25 | 60 | 352 | 412 | 20 | 53 | 73 | 82 |
| | 224 | 750 | 25 | 60 | 352 | 412 | — | 47 | — | — |
| | 248 | 750 | 25 | 60 | 352 | 412 | 23 | 55 | 78 | 81 |
| | 272 | 750 | 25 | 60 | 352 | 412 | 24 | 58 | 82 | 80 |
| | 296 | 750 | 25 | 60 | 352 | 412 | 25 | 57 | 82 | 80 |
| | 320 | 750 | 25 | 60 | 352 | 412 | 21 | 49 | 70 | 83 |
| 6 | 31 | 750 | 25 | 65 | 353 | 418 | — | — | — | — |
| (Invention) | 55 | 750 | 25 | 65 | 353 | 418 | 17 | 49 | 66 | 84 |
| Fe Added | 79 | 750 | 25 | 65 | 353 | 418 | 19 | 55 | 74 | 82 |
| | 103 | 750 | 25 | 65 | 353 | 418 | 20 | 61 | 81 | 81 |
| | 127 | 750 | 25 | 65 | 353 | 418 | 22 | 65 | 87 | 79 |
| | 151 | 750 | 25 | 65 | 353 | 418 | 24 | 72 | 96 | 77 |
| | 175 | 750 | 25 | 65 | 353 | 418 | 25 | 73 | 98 | 77 |
| | 199 | 750 | 25 | 65 | 353 | 418 | 24 | 71 | 95 | 77 |
| | 223 | 750 | 25 | 65 | 353 | 418 | 23 | 69 | 92 | 78 |
| | 247 | 750 | 25 | 65 | 353 | 418 | 24 | 67 | 91 | 78 |
| | 271 | 750 | 25 | 65 | 353 | 418 | 25 | 76 | 101 | 76 |
| | 295 | 750 | 25 | 65 | 353 | 418 | 24 | 75 | 99 | 76 |
| | 319 | 750 | 25 | 65 | 353 | 418 | 27 | 83 | 110 | 74 |

The data in Table II shows that the additives of this invention, comprising either a cobalt naphthenate (run 5) or an iron naphthenate (run 6), were more effective demetallizing agents than the molybdenum dithiophosphate (run 2), the molybdenum naphthenate (run 3) and the vanadyl naphthenate (run 4). These results are particularly surprising in view of the known demetallization activity of molybdenum.

EXAMPLE III

This example compares the demetallization activity of two decomposable molybdenum additives. In this example, a Hondo Californian heavy crude was hydrotreated in accordance with the procedure described in Example II, except that the liquid hourly space velocity (LHSV) of the oil was maintained at about 1.5 cc/cc catalyst/hr. The molybdenum compound added to the feed in run 1 was $Mo(CO)_6$ (marketed by Aldrich Chemical Company, Milwaukee, Wis.). The molybdenum compound added to the feed in run 2 was Molyvan ®L. The results of these tests are set forth in Table III.

TABLE III

| Run | Days on Stream | Temp (°F.) | PPM in Feed Added Mo | Ni | Ni | V | Ni + V | PPM in Product Ni | V | Ni + V | % Removal of (Ni + V) |
|---|---|---|---|---|---|---|---|---|---|---|---|
| 1 | 1 | 750 | 20 | 0 | 103 | 248 | 351 | 22 | 38 | 60 | 83 |
| (Control) | 1.5 | 750 | 20 | 0 | 103 | 248 | 351 | 25 | 42 | 67 | 81 |
| Mo $(CO)_6$ | 2.5 | 750 | 20 | 0 | 103 | 248 | 351 | 28 | 42 | 70 | 80 |
| Added | 3.5 | 750 | 20 | 0 | 103 | 248 | 351 | 19 | 35 | 54 | 85 |
| | 6 | 750 | 20 | 0 | 103 | 248 | 351 | 29 | 38 | 67 | 81 |
| | 7 | 750 | 20 | 0 | 103 | 248 | 351 | 25 | 25 | 50 | 86 |
| | 8 | 750 | 20 | 0 | 103 | 248 | 351 | 27 | 35 | 62 | 82 |
| | 9 | 750 | 20 | 0 | 103 | 248 | 351 | 27 | 35 | 62 | 82 |
| | 10 | 750 | 20 | 0 | 103 | 248 | 351 | 32 | 35 | 67 | 81 |

TABLE III-continued

| Run | Days on Stream | Temp (°F.) | PPM in Feed Added Mo | Ni | Ni | V | Ni + V | PPM in Product Ni | V | Ni + V | % Removal of (Ni + V) |
|---|---|---|---|---|---|---|---|---|---|---|---|
| | 11 | 750 | 20 | 0 | 103 | 248 | 351 | 25 | 35 | 60 | 83 |
| | 12 | 750 | 20 | 0 | 103 | 248 | 351 | 27 | 34 | 61 | 83 |
| | 13 | 750 | 20 | 0 | 103 | 248 | 351 | 31 | 35 | 66 | 81 |
| | 14 | 750 | 20 | 0 | 103 | 248 | 351 | 36 | 52 | 88 | 75 |
| | 15 | 750 | 20 | 0 | 103 | 248 | 351 | 47 | 68 | 115 | 67(1) |
| 2 | 1 | 750 | 20 | 0 | 78(2) | 181(2) | 259(2) | 23 | 39 | 62 | 76 |
| (Comparative) | 3 | 750 | 20 | 0 | 78 | 181 | 259 | 30 | 38 | 68 | 74 |
| Molyvan ® L | 4 | 750 | 20 | 0 | 78 | 181 | 259 | 27 | 42 | 69 | 73 |
| Added | 5 | 750 | 20 | 0 | 78 | 181 | 259 | 27 | 40 | 67 | 74 |
| | 6 | 750 | 20 | 0 | 78 | 181 | 259 | 27 | 41 | 68 | 74 |
| | 7 | 750 | 20 | 0 | 78 | 181 | 259 | 25 | 37 | 62 | 76 |
| | 8 | 750 | 20 | 0 | 78 | 181 | 259 | 26 | 39 | 65 | 75 |
| | 10 | 754 | 20 | 0 | 78 | 181 | 259 | 21 | 35 | 56 | 78 |
| | 11 | 750 | 20 | 0 | 78 | 181 | 259 | 23 | 38 | 61 | 76 |

(1)Result believed to be erroneous (2)The (Ni + V) content of the feed of run 2 appears to be too low; this feed is essentially the same as the feed of run 1, but with Molyvan ® L added; thus the % removal of (Ni + V) may be somewhat higher than shown for run 2.

The data in Table IV, when read in view of footnote 2, shows that the dissolved molybdenum dithiophosphate (Molyvan ®L) was essentially as effective a demetallizing agent as $Mo(CO)_6$. Based upon these results and the results of Example II, it is believed that the inventive additives are at least as effective, as demetallizing agents, as $Mo(CO)_6$.

EXAMPLE IV

This example illustrates the rejuvenation of a substantially deactivated, sulfided, promoted desulfurization catalyst (referred to as catalyst D in Table I) by the addition of a decomposable Mo compound to the feed. The process was essentially in accordance with Example I except that the amount of Catalyst D was 10 cc. The feed was a supercritical Monagas oil extract containing about 29–35 ppm Ni, about 103–113 ppm V, about 3.0–3.2 weight-% S and about 5.0 weight-% Ramsbottom carbon. LHSV of the feed was about 5.0 cc/cc catalyst/hr; the pressure was about 2250 psig; the hydrogen feed rate was about 1000 SCF $H_2$ per barrel of oil; and the reactor temperature was about 775° F. (413° C.). During the first 600 hours on stream, no Mo was added to the feed. Thereafter $Mo(CO)_6$ was added. The results of this test are summarized in Table IV.

TABLE IV

| Hours on Stream | Feed Added Mo (ppm) | Ni (ppm) | V (ppm) | (Ni + V) (ppm) | Product Ni (ppm) | V (ppm) | (Ni + V) (ppm) | % Removal of (Ni + V) |
|---|---|---|---|---|---|---|---|---|
| 46 | 0 | 35 | 110 | 145 | 7 | 22 | 29 | 80 |
| 94 | 0 | 35 | 110 | 145 | 8 | 27 | 35 | 76 |
| 118 | 0 | 35 | 110 | 145 | 10 | 32 | 42 | 71 |
| 166 | 0 | 35 | 110 | 145 | 12 | 39 | 51 | 65 |
| 190 | 0 | 32 | 113 | 145 | 14 | 46 | 60 | 59 |
| 238 | 0 | 32 | 113 | 145 | 17 | 60 | 77 | 47 |
| 299 | 0 | 32 | 113 | 145 | 22 | 79 | 101 | 30 |
| 377 | 0 | 32 | 113 | 145 | 20 | 72 | 92 | 37 |
| 430 | 0 | 32 | 113 | 145 | 21 | 74 | 95 | 34 |
| 556 | 0 | 29 | 108 | 137 | 23 | 82 | 105 | 23 |
| 586 | 0 | 29 | 108 | 137 | 24 | 84 | 108 | 21 |
| 646 | 68 | 29 | 103 | 132 | 22 | 72 | 94 | 29 |
| 676 | 68 | 29 | 103 | 132 | 20 | 70 | 90 | 32 |
| 682 | 117 | 28 | 101 | 129 | 18 | 62 | 80 | 38 |
| 706 | 117 | 28 | 101 | 129 | 16 | 56 | 72 | 44 |
| 712 | 117 | 28 | 101 | 129 | 16 | 50 | 66 | 49 |
| 736 | 117 | 28 | 101 | 129 | 9 | 27 | 36 | 72 |
| 742 | 117 | 28 | 101 | 129 | 7 | 22 | 29 | 78 |
| 766 | 117 | 28 | 101 | 129 | 5 | 12 | 17 | 87 |

The data in Table IV shows that the demetallization activity of a substantially deactivated catalyst (removal of Ni+V after 586 hours: 21%) was dramatically increased (to about 87% removal of Ni+V) by the addition of $Mo(CO)_6$ for about 120 hours. At the time when the Mo addition commenced, the deactivated catalyst had a metal (Ni+V) loading of about 34 weight-% (i.e., the weight of the fresh catalyst had increased by 34% due to the accumulation of metals). At the conclusion of the test run, the metal (Ni+V) loading was about 44 weight-%. Sulfur removal was not significantly affected by the addition of Mo. Based upon these results, it is believed that the addition of the inventive additive to the feed would also be beneficial in enhancing the demetallization activity of substantially deactivated catalysts.

While this invention has been described in detail for the purpose of illustration, it is not to be construed as limited thereby but is intended to cover all changes and modifications within the spirit and scope thereof.

That which is claimed is:

1. A process for hydrofining a hydrocarbon-containing feed stream comprising the steps of:

introducing an additive comprising a metal naphthenate selected from the group consisting of cobalt naphthenate and iron naphthenate into said hydrocarbon-containing feed stream;

contacting the hydrocarbon-containing feed stream containing said additive under suitable hydrofining conditions with hydrogen and a catalyst composition consisting essentially of a support selected from the group consisting of alumina, silica and silica-alumina and a promoter consisting essentially of at least one metal selected from Group VIB, Group VIIB and Group VIII of the Periodic Table.

2. A process in accordance with claim 1, wherein said metal naphthenate is cobalt naphthenate.

3. A process in accordance with claim 2 wherein a sufficient quantity of said additive is added to said hydrocarbon-containing feed stream to result in an added concentration of cobalt in said hydrocarbon-containing feed stream in the range of about 1 ppm to about 60 ppm.

4. A process in accordance with claim 3 wherein said concentration is in the range of about 2 ppm to about 30 ppm.

5. A process in accordance with claim 1 wherein said metal naphthenate is iron naphthenate.

6. A process in accordance with claim 5 wherein a sufficient quantity of said additive is added to said hydrocarbon-containing feed stream to result in an added concentration of iron in said hydrocarbon-containing feed stream in the range of about 1 ppm to about 60 ppm.

7. A process in accordance with claim 6 wherein said concentration is in the range of about 2 ppm to about 30 ppm.

8. A process in accordance with claim 1 wherein said catalyst composition consists essentially of alumina, nickel and molybdenum.

9. A process in accordance with claim 1 wherein said catalyst composition consists essentially of alumina, cobalt and molybdenum.

10. A process in accordance with claim 9 wherein said catalyst composition additionally consists essentially of nickel.

11. A process in accordance with claim 1 wherein said suitable hydrofining conditions comprise a reaction time between said catalyst composition and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

12. A process in accordance with claim 1 wherein said suitable hydrofining conditions comprise a reaction time between said catalyst composition and said hydrocarbon-containing feed stream in the range of about 0.3 hours to about 5 hours, a temperature in the range of 340° C. to about 440° C., a pressure in the range of about 500 to about 3,000 psig and a hydrogen flow rate in the range of about 1,000 to about 6,000 standard cubic feet per barrel of said hydrocarbon-containing feed stream.

13. A process in accordance with claim 1 wherein the addition of said additive to said hydrocarbon-containing feed stream is interrupted periodically.

14. A process in accordance with claim 1 wherein said hydrofining process is a demetallization process and wherein said hydrocarbon-containing feed stream contains metals.

15. A process in accordance with claim 14 wherein said metals are nickel and vanadium.

16. In a hydrofining process in which a hydrocarbon-containing feed stream is contacted under suitable hydrofining conditions with hydrogen and a catalyst composition consisting essentially of a support selected from the group comprising alumina, silica and silica-alumina and a promoter consisting of at least one metal selected from Group VIB, Group VIIB, and Group VIII of the periodic table and in which said catalyst composition has been at least partially deactivated by use in said hydrofining process, a method for improving the activity of said catalyst composition for said hydrofining process comprising the step of adding an additive comprising a metal naphthenate selected from the group consisting of cobalt naphthenate and iron naphthenate to said hydrocarbon-containing feed stream under suitable mixing conditions prior to contacting said hydrocarbon-containing feed stream with said catalyst composition.

17. A process in accordance with claim 16 wherein said metal naphthenate is cobalt naphthenate.

18. A process in accordance with claim 17 wherein a sufficient quantity of said additive is added to said hydrocarbon-containing feed stream to result in an added concentration of cobalt in said hydrocarbon-containing feed stream in the range of about 1 ppm to about 60 ppm.

19. A process in accordance with claim 18 wherein said concentration is in the range of about 2 ppm to about 30 ppm.

20. A process in accordance with claim 16 wherein said metal naphthenate is iron naphthenate.

21. A process in accordance with claim 20 wherein a sufficient quantity of said additive is added to said hydrocarbon-containing feed stream to result in an added concentration of iron in said hydrocarbon-containing feed stream in the range of about 1 ppm to about 60 ppm.

22. A process in accordance with claim 21 wherein said concentration is in the range of about 2 ppm to about 30 ppm.

23. A process in accordance with claim 16 wherein said catalyst composition is a spent catalyst composition due to use in said hydrofining process.

24. A process in accordance with claim 16 wherein said catalyst composition consists essentially of alumina, nickel and molybdenum.

25. A process in accordance with claim 16 wherein said catalyst composition consists essentially of alumina, cobalt and molybdenum.

26. A process in accordance with claim 25 wherein said catalyst composition additionally consists essentially of nickel.

27. A process in accordance with claim 16 wherein said suitable hydrofining conditions comprise a reaction time between said catalyst composition and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

28. A process in accordance with claim 16 wherein said suitable hydrofining conditions comprise a reaction time between said catalyst composition and said hydrocarbon-containing feed stream in the range of about 0.3 hours to about 5 hours, a temperature in the range of 340° C. to about 440° C., a pressure in the range of about 500 to about 3,000 psig and a hydrogen flow rate in the range of about 1,000 to about 6,000 standard cubic feet per barrrel of said hydrocarbon-containing feed stream.

29. A process in accordance with claim 16 wherein the adding of said metal naphthenate to said hydrocarbon-containing feed stream is interrupted periodically.

30. A process in accordance with claim 16 wherein said hydrofining process is a demetallization process and wherein said hydrocarbon-containing feed stream contains metals.

31. A process in accordance with claim 30 wherein said metals are nickel and vanadium.

* * * * *